US010408461B2

(12) United States Patent
Wie et al.

(10) Patent No.: US 10,408,461 B2
(45) Date of Patent: Sep. 10, 2019

(54) GAS COOKER

(71) Applicant: LG ELECTRONICS INC., Seoul (KR)

(72) Inventors: Jeahyuk Wie, Seoul (KR); Hyunwoo Park, Seoul (KR); Youngsoo Kim, Seoul (KR); Daebong Yang, Seoul (KR)

(73) Assignee: LG Electronics Inc., Seoul (KR)

( * ) Notice: Subject to any disclaimer, the term of this patent is extended or adjusted under 35 U.S.C. 154(b) by 270 days.

(21) Appl. No.: 15/255,453

(22) Filed: Sep. 2, 2016

(65) Prior Publication Data

US 2017/0067647 A1 Mar. 9, 2017

(30) Foreign Application Priority Data

Sep. 3, 2015 (KR) ..... 10-2015-0125169
Sep. 3, 2015 (KR) ..... 10-2015-0125176

(51) Int. Cl.

| | |
|---|---|
| ***F24C 3/08*** | (2006.01) |
| ***F24C 3/12*** | (2006.01) |
| ***F24C 3/04*** | (2006.01) |
| ***F24C 3/10*** | (2006.01) |
| ***F24C 15/00*** | (2006.01) |
| ***F23D 14/14*** | (2006.01) |

(Continued)

(52) U.S. Cl.

CPC ..... *F24C 3/124* (2013.01); *F23D 14/14* (2013.01); *F23D 14/78* (2013.01); *F24C 3/047* (2013.01); *F24C 3/085* (2013.01); *F24C 3/103* (2013.01); *F24C 3/126* (2013.01); *F24C 15/006* (2013.01); *F24C 15/101* (2013.01)

(58) Field of Classification Search

CPC ..... F24C 3/08; F24C 3/103; F24C 15/001; F24C 15/101; F24C 15/108
USPC ..... 126/39 K, 39 H, 39 J, 39 N, 39 R
See application file for complete search history.

(56) References Cited

U.S. PATENT DOCUMENTS 3,468,298 A * 9/1969 Teague, Jr. ..... F23D 14/60 126/39 J
3,785,364 A 1/1974 Reid et al.
6,076,517 A 6/2000 Kahlke et al.
(Continued)

FOREIGN PATENT DOCUMENTS

CN 1548810 11/2004
CN 201416933 3/2010
(Continued)

OTHER PUBLICATIONS

Extended European Search Report in European Appln. No. 16842294.7, dated Mar. 19, 2019, 10 pages.

*Primary Examiner* — Vivek K Shirsat
(74) *Attorney, Agent, or Firm* — Fish & Richardson P.C.

(57) ABSTRACT

A gas cooker that includes a case defining an interior area, the case including an opening to the interior area; a plate covering, fully or in part, the opening of the case; a burner unit that is located in the interior area of the case, wherein the burner unit includes a heating element that is heated using gas; an operation unit that is located at a first portion of the case and that is configured to control the burner unit based on user input; an exhaust outlet that is located at a second portion of the case; and a first cooling unit that is located in the interior area of the case and that is configured to generate air flow toward the exhaust outlet is disclosed.

19 Claims, 18 Drawing Sheets

(51) Int. Cl.
*F23D 14/78* (2006.01)
*F24C 15/10* (2006.01)

(56) References Cited

U.S. PATENT DOCUMENTS

| | | | | |
|---|---|---|---|---|
| 2006/0048767 | A1* | 3/2006 | Lee | F24C 3/067<br>126/214 R |
| 2008/0149092 | A1* | 6/2008 | Lee | F24C 3/047<br>126/39 J |
| 2010/0108053 | A1* | 5/2010 | Lee | F24C 15/006<br>126/39 H |

FOREIGN PATENT DOCUMENTS

| | | |
|---|---|---|
| CN | 201973752 | 9/2011 |
| JP | H10-103621 | 4/1998 |
| JP | 2002-352946 | 12/2002 |
| JP | 2008-089229 | 4/2008 |
| JP | 2009-272312 | 11/2009 |
| KR | 10-2002-0056248 | 7/2002 |
| KR | 10-2002-0056337 | 7/2002 |
| KR | 1020060120398 | 11/2006 |
| KR | 10-0829624 | 5/2008 |
| KR | 10-2009-0059006 | 6/2009 |
| KR | 10-2011-0070453 | 6/2011 |
| KR | 10-2011-0089543 | 8/2011 |
| WO | WO2003060382 | 7/2003 |
| WO | WO2008091057 | 7/2008 |

* cited by examiner

GAS COOKER

CROSS-REFERENCE TO RELATED APPLICATION

The application claims priority under 35 U.S.C. § 119 and 35 U.S.C. § 365 to the Korean Patent Application No. 10-2015-0125176 filed on Sep. 3, 2015 and the Korean Patent Application No. 10-2015-0125169 filed on Sep. 3, 2015, the entire disclosure of each application is hereby incorporated by reference.

TECHNICAL FIELD

The present disclosure generally relates to a gas cooker.

BACKGROUND

A gas cooker is a home appliance that cooks food using heat. The gas cooker provides heat using gas.

The gas cooker is classified into an open-flame type in which a burner is exposed to an outside of a product, and flame directly heats food or heats a container in which the food is put, and a radiant type in which the burner is provided inside the product, and a radiator is heated using combustion heat, and the food or the container in which the food is put is heated using a radiant wave emitted from the heated radiator to an outside.

Korean Patent Publication No. 10-2008-0069449 discloses a heating cooker in which an upper surface of a case is shielded by a ceramic plate, and a burner system ignited by supplying a gas is provided at an internal space of the case under the ceramic plate, and heating power is controlled by opening and closing a gas valve through an operation of an operation switch.

There is a problem that a malfunction may occur when electronic components are provided inside the case because a separate structure for cooling the inside of the case is not provided in the cooker having the above structure.

Also, since the temperature of exhaust gas discharged after combustion is high, a user may raise emotional complaints, and there is a problem that stability is degraded due to the high temperature exhaust gas.

SUMMARY

The present disclosure is related to a gas cooker that effectively cools electronic components inside a case and improve stability by reducing the discharge temperature of exhaust gas.

In general, one innovative aspect of the subject matter described in this specification can be embodied in a gas cooker comprising a case defining an interior area, the case including an opening to the interior area; a plate covering, fully or in part, the opening of the case; a burner unit that is located in the interior area of the case, wherein the burner unit includes a heating element that is heated using gas; an operation unit that is located at a first portion of the case and that is configured to control the burner unit based on user input; an exhaust outlet that is located at a second portion of the case; and a first cooling unit that is located in the interior area of the case and that is configured to generate air flow toward the exhaust outlet.

The foregoing and other embodiments can each optionally include one or more of the following features, alone or in combination. In particular, one embodiment includes all the following features in combination. The operation unit includes: a circuit unit that is coupled with the plate and that includes a touch sensor configured to sense the user input, and wherein the first cooling unit is configured to generate air flow between the circuit unit and a first surface of the case. The gas cooker includes a spark plug configured to ignite fire to provide heat to the heating element; and a valve configured to control an amount of gas that is provided to the burner unit, wherein the circuit unit includes: a first circuit unit that includes the touch sensor, and a second circuit unit that is configured to control the first cooling unit, the spark plug, and the valve, and wherein the first cooling unit is configured to provide air flow between the first circuit unit and the second circuit unit. The burner unit includes: a burner port configured to hold the heating element, a mixing tube coupled to the burner port, a nozzle configured to provide gas to the mixing tube, and a blocking member configured to block air flow that is provided from the first cooling unit. The burner unit includes a first burner located at a first position inside the case, and a second burner located at a second position inside the case, wherein the first cooling unit is located at a third position, inside the case, that is a position between the operation unit, the first burner, and the second burner. The burner unit includes: a plurality of burners, and an insulating case that defines a first interior area, the insulating case including a first opening to the first interior area, the first opening being, fully or partly, covered by the plate, a plurality of second openings that hold the plurality of burners, and a concaved portion that is coupled with the first cooling unit, wherein the first cooling unit is configured to generate air flow to the plate through the concaved portion of the insulating case. The case includes: a first cooling unit installing portion that is coupled to the first cooling unit and that includes one or more openings that allow air to flow into the interior area from an exterior of the case. The gas cooker includes: a bracket that is coupled between the first cooling unit and the concaved portion of the insulating case. The bracket includes: a coupling portion that is coupled to the concaved portion of the insulating case, and a fixing portion that is coupled to the first cooling unit and that enables coupling of the first cooling unit to the first cooling unit installing portion of the case. The insulating case is located in the interior area of the case and isolated from a first surface of the case and a second surface of the case, and wherein the first cooling unit is configured to generate air flow between the insulating case and the case. The insulating case includes an exhaust opening that is located on a first surface of the insulating case and that allows air to flow from the first cooling unit to pass through the exhaust opening.

In general, one innovative aspect of the subject matter described in this specification can be embodied in a gas cooker including a case defining an interior area, the case including an opening to the interior area; a plate covering, fully or in part, the opening of the case; a burner unit that is located in the interior area of the case, wherein the burner unit includes a heating element that is heated using gas; an operation unit that is located at a first portion of the case and that is configured to control the burner unit based on user input; an exhaust outlet that is located at a second portion of the case; a first barrier that is located in the interior area of the case and that divides the interior area into a first area and a second area; a first cooling unit that is located in the first area of the interior area and that is configured to generate air flow toward the exhaust outlet through the first area; and a second cooling unit that is located in the second area of the interior area and that is configured to generate air flow toward the exhaust outlet through the second area.

The foregoing and other embodiments can each optionally include one or more of the following features, alone or in combination. In particular, one embodiment includes all the following features in combination. The gas cooker includes: a second barrier that is located in the first area of the interior area and that divides the first area into a third area and a fourth area, wherein the first cooling unit is located in the third area. The first barrier is coupled to a first surface of the case and a second surface of the case. The burner unit includes an exhaust opening that allows air to flow from the first cooling unit and the second cooling unit toward the exhaust outlet, wherein the first barrier is coupled to a first surface of the burner unit. The burner unit is isolated from a first surface of the case, and wherein air flow from the first cooling unit passes between the burner unit and the case. The gas cooker includes a regulator configured to control gas pressure; and a valve unit configured to control an amount of gas that is provided to the burner unit, wherein the regulator and the valve unit are located in the second area of the interior area. The burner unit includes: a plurality of burners, and an insulating case that includes a plurality of openings that hold the plurality of burners. The first barrier is coupled to a first surface of the insulating case, a first surface of the case, and a second surface of the case. The first barrier includes: a seating portion that holds the second cooling unit; and a partitioning portion that is bent from the seating portion and that divides the interior area into the first area and the second area.

The details of one or more examples of the subject matter described in this specification are set forth in the accompanying drawings and the description below. Other potential features, aspects, and advantages of the subject matter will become apparent from the description, the drawings, and the claim.

DETAILED DESCRIPTION

Figure 1:
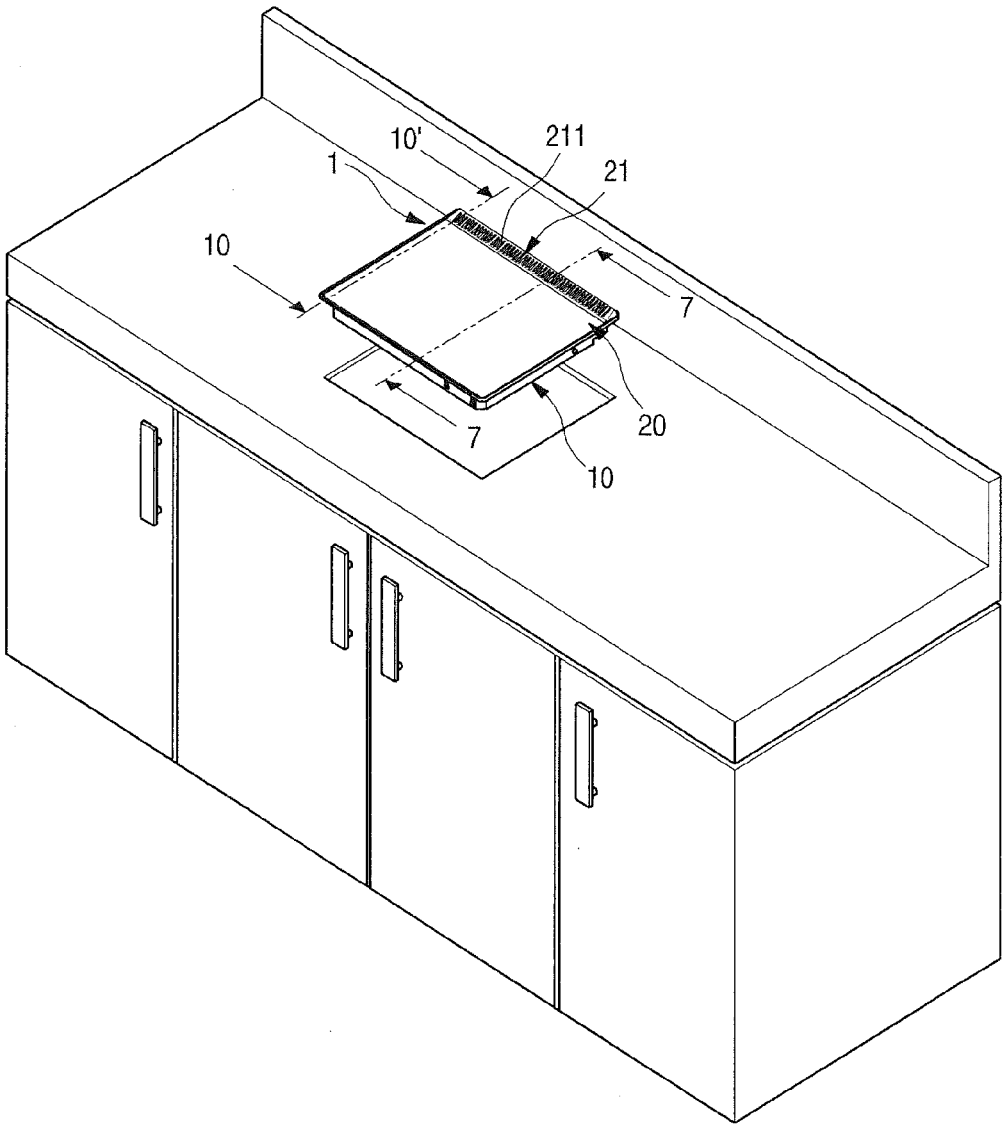
FIG. 1 is a diagram illustrating an example gas cooker.

FIG. 1 illustrates an example gas cooker. A gas cooker 1 may be installed at an upper surface of furniture such as a sink. The gas cooker 1 is formed to be seated in an opening formed at an upper surface of the sink, and an exterior thereof exposed through the upper surface of the sink may be formed by a top plate 20.

And the entire exterior of the gas cooker 1 may be configured with a case 10, the top plate 20 and an exhaust outlet 21.

The case 10 may be formed of a plate-shaped steel material, and an upper surface thereof is bent to be opened, and thus a space in which a plurality of elements for operating the gas cooker 1 are accommodated is provided therein. And when the gas cooker 1 is installed at the sink, the case 10 is in an accommodated state inside the opening of the sink.

The top plate 20 forming an upper surface of the gas cooker 1 is provided at the opened upper surface of the case 10. The top plate 20 shields the opening of the sink while the gas cooker 1 is installed at the sink, is exposed through the upper surface, and forms the exterior of the upper surface of the gas cooker 1. And the top plate 20 provides a flat surface on which food to be cooked is seated.

And the exhaust outlet 21 through which exhaust gas is discharged is provided at a rear end of the top plate 20. The exhaust outlet 21 is formed to slightly protrude from the top plate 20, and a plurality of vent holes 211 are opened at the exhaust outlet 21 so that the exhaust gas is discharged through the vent holes 211.

Figure 2:
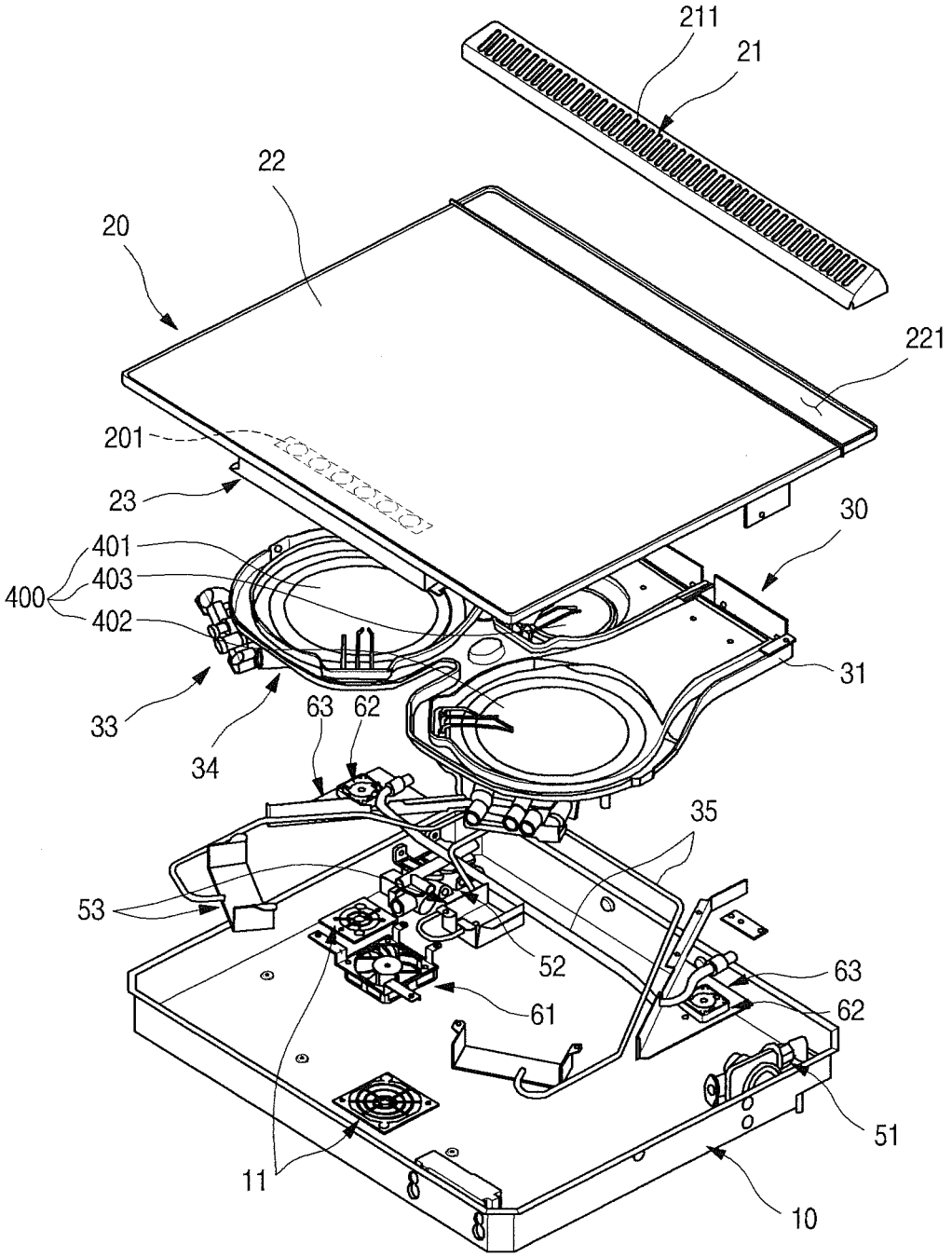
FIG. 2 is a diagram illustrating an inside area of an example gas cooker.
Figure 3:
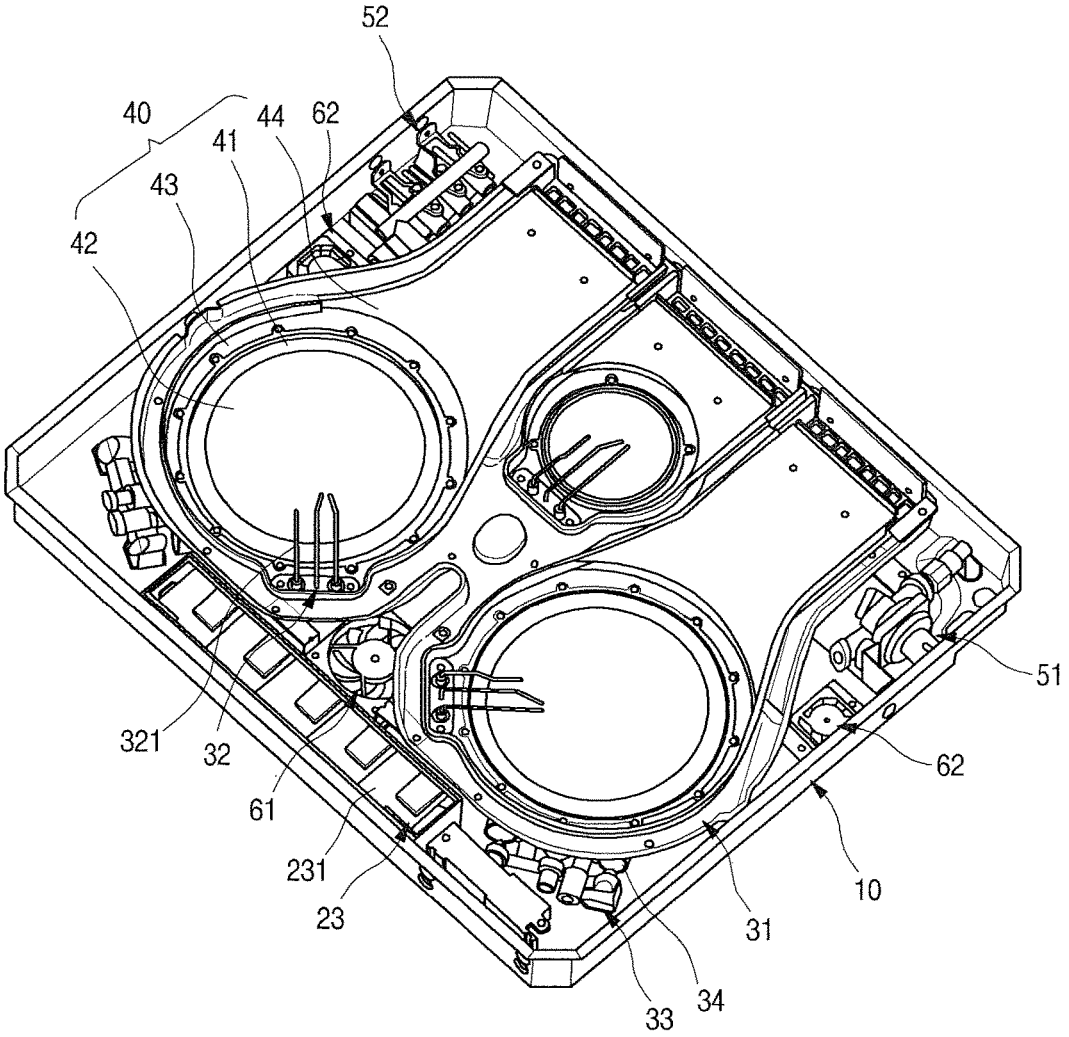
FIG. 3 is a diagram illustrating an inside area of an example gas cooker.
Figure 4:
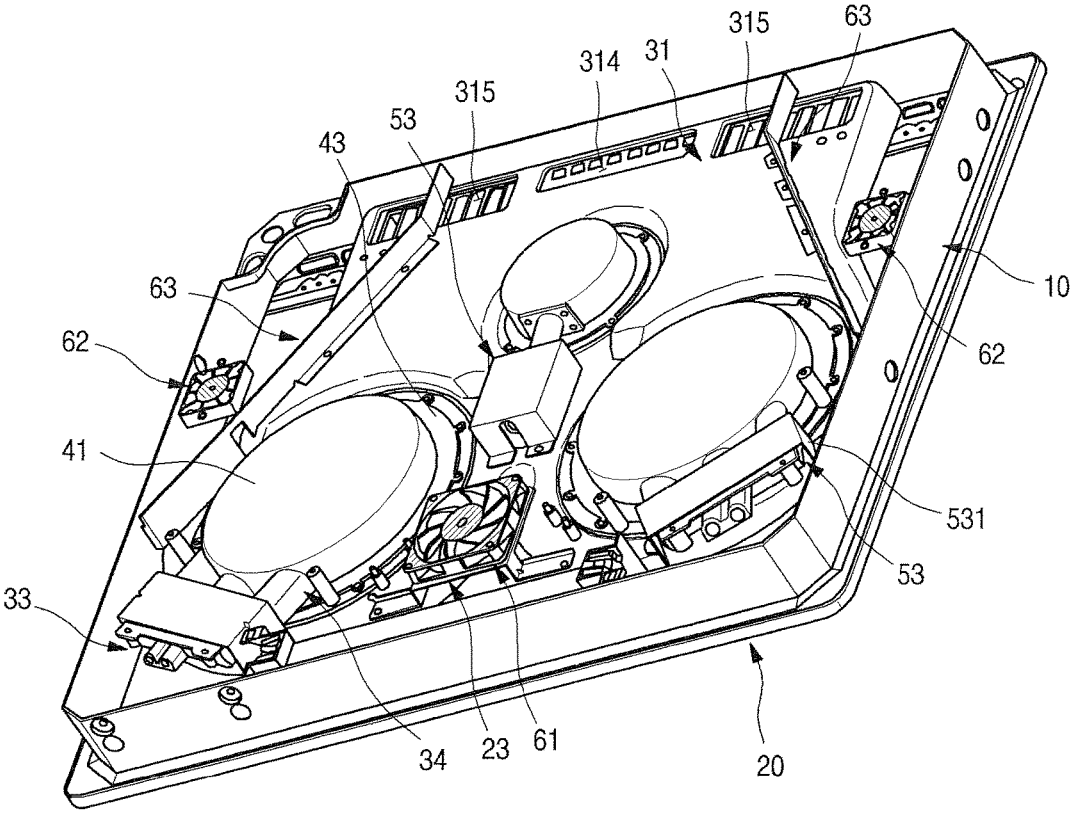
FIG. 4 is a diagram illustrating an inside area of an example gas cooker.

FIGS. 2-4 illustrate an inside area of an example gas cooker.

A configuration of the gas cooker will be described in detail with reference to the drawings. The upper surface of the gas cooker 1 is formed by the top plate 20, and the other exterior except the upper surface is formed by the case 10.

The top plate 20 may be formed of a ceramic glass material, and a top frame 22 may be provided at a perimeter of the top plate 20, and may form an exterior of the perimeter of the top plate 20. And an exhaust outlet seating portion 221 which is opened so that the exhaust outlet 21 is seated therein may be further formed at the top frame 22.

An operation unit 23 may be provided under the top plate 20. The operation unit 23 is operated to control heating power of the gas cooker 1 by a user, and may be formed to be operated by the user's touching operation. In some implementations, the operation unit 23 may be configured with an electronic switch or a sensor, instead of a touching method.

An operation part 201 which enables the user to recognize an operating portion of the operation unit 23 may be formed at an upper surface of the top plate 20 corresponding to the operation unit 23. The operation part 201 may be formed at the upper surface of the top plate 20 in a printing method or a film attaching method, and may also be formed in a transparent or translucent type so that at least a part of the operation unit 23 is exposed. Also, the operation part 201 may be formed not to be recognized from an outside through the top plate 20 before an operation thereof, but to be recognized from the outside by turning on a separate backlight.

The operation unit 23 may be located at a front end of the top plate 20, and may be formed so that an upper end of the operation unit 23 is in completely close contact with the top plate 20. And the operation unit 23 may also be formed to be coupled to the top plate 20 and thus to be disassembled from or assembled to the case 10 in a module state.

In some implementations, the opened upper surface of the case 10 may be formed to have a smaller area than that of the top plate 20, and may also be formed to have a structure in which the perimeter of the top plate 20 further protrudes to an outside of the case 10 when being coupled to the top plate 20. And an exterior of the case 10 may be formed by bending the steel plate material, and if necessary, may be formed by injection-molding a resin material.

When the top plate 20 and the case 10 are coupled to each other, a space is formed inside the case 10, and a burner unit 30 may be provided in the space. The burner unit 30 may include a plurality of burners 40 in which combustion of a supplied mixed gas occurs, and an insulating case 31 at which the burners 40 are fixed and installed.

Each of the burners 40 may include a burner port 41 to which the mixed gas is supplied, a red-heat plate 42 which is seated at the burner port 41 to be heated by the combustion of the mixed gas, and a burner holder 43 and a burner cover 44 which support the burner port 41 and red-heat plate 42. A structure and shape of the burner unit 30 may be applied variously.

The burner holder 43 and the burner cover 44 are formed to be extended to the rear, and may extend to a rear end of the case 10 corresponding to a location of the exhaust outlet 21. Therefore, the burned gas generated when the combustion occurs at the burner 40 may be guided to the exhaust outlet 21 by the guidance of the burner holder 43 and the burner cover 44, and then may be discharged to an outside.

In some implementations, an insulator for preventing heat of the burner unit 30 from being transferred to the outside of the case 10 or some areas of the top plate 20 may be provided between the burner holder 43 and the top plate 20 and between the burner holder 43 and the insulating case 31.

A spark plug 32 for ignition of the mixed gas may be provided in the burner 40. The spark plug 32 is provided above the red-heat plate 42, and extends from an outside of the red-heat plate 42 toward an inside thereof to ignite the mixed gas.

Also, a flame detecting units 321 may be provided at one side of the spark plug 32. The flame detecting units 321 serves to check an ignition state of the burner 40 through a change in a voltage or a temperature of the red-heat plate 42 and may be formed in a module integrally formed with the spark plug 32, and may extend along with the spark plug 32 from an upper side of the red-heat plate 42 toward the inside of the red-heat plate 42.

Each of the burners 40 has a nozzle 33 for supplying the gas, and a mixing tube 34 through which a fuel gas and air are mixed and introduced to a burner port 41 may be provided at an outlet side of the nozzle 33. The nozzle 33 and the mixing tube 34 may be formed in one module, and may be respectively fixed to and installed at the burner port 41.

The plurality of burners 40 may be provided, and may include a first burner 401 and a second burner 402 which are provided at both of left and right sides inside the case 10, and a third burner 403 which is provided between the first burner 401 and the second burner 402 provided at both of the left and right sides and has a size smaller than each of the first burner 401 and the second burner 402. And all of the first burner 401, the second burner 402 and the third burner 403 may be seated on the insulating case 31, and may be installed inside the case 10. The number of burners 40 and a size of each of the burners 40, which are installed at the insulating case 31, are not limited to the example described above, and may be changed.

In some implementations, a gas pipe 35 is provided inside the case 10. The gas pipe 35 connects a regulator 51 and a valve unit 52 with the burners 40 so that the gas is supplied to each of the burners 40. At this point, the regulator 51 and the valve unit 52 which are operated by an electronic control method may be commonly referred to as electronic components. A first cooling unit 61 and a second cooling unit 62 may be located inside the case 10. The first cooling unit 61 and the second cooling unit 62 generates air flow to cool down an interior area of the case 10. In some implementations, the first cooling unit 61 and the second cooling unit 61 can be implemented as a fan. The first cooling unit 61 can be a main fan 61 and the second cooling unit can be a sub-fan 62.

Figure 5:
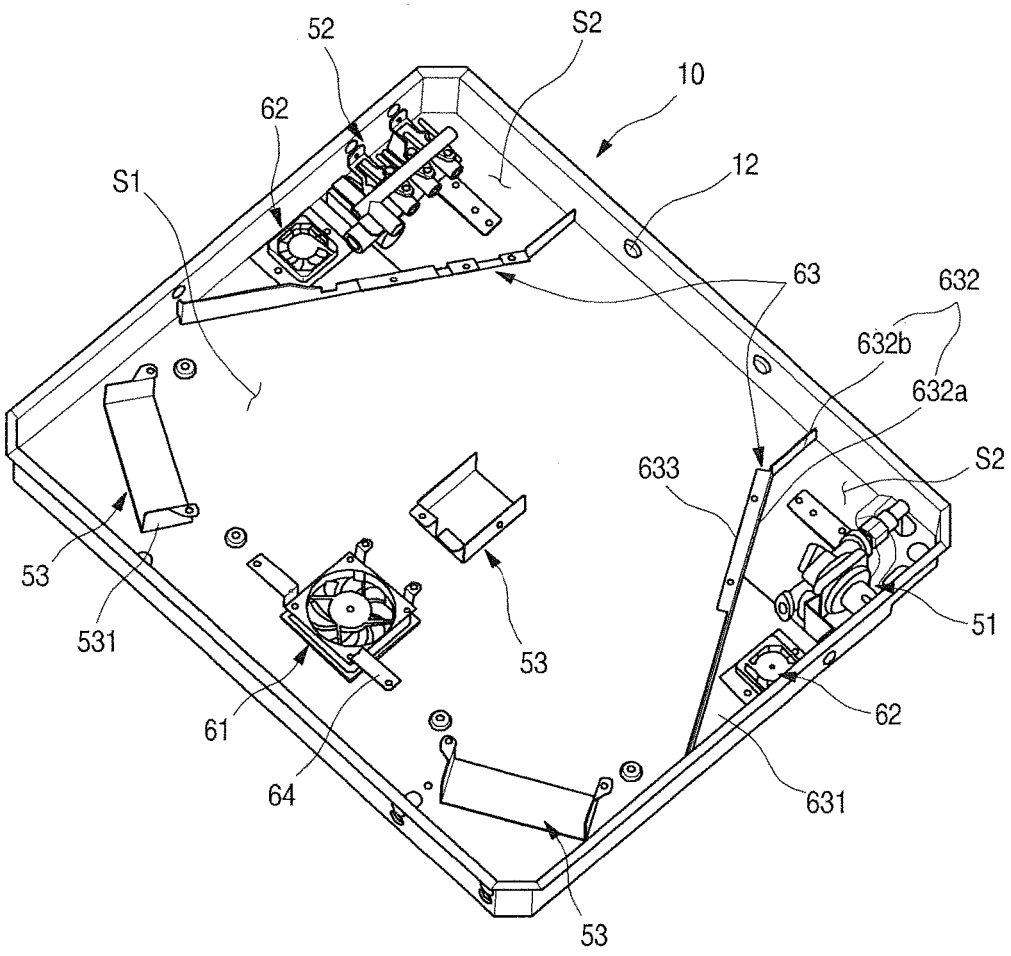
FIG. 5 is a diagram illustrating an inside area of an example gas cooker.
Figure 6:
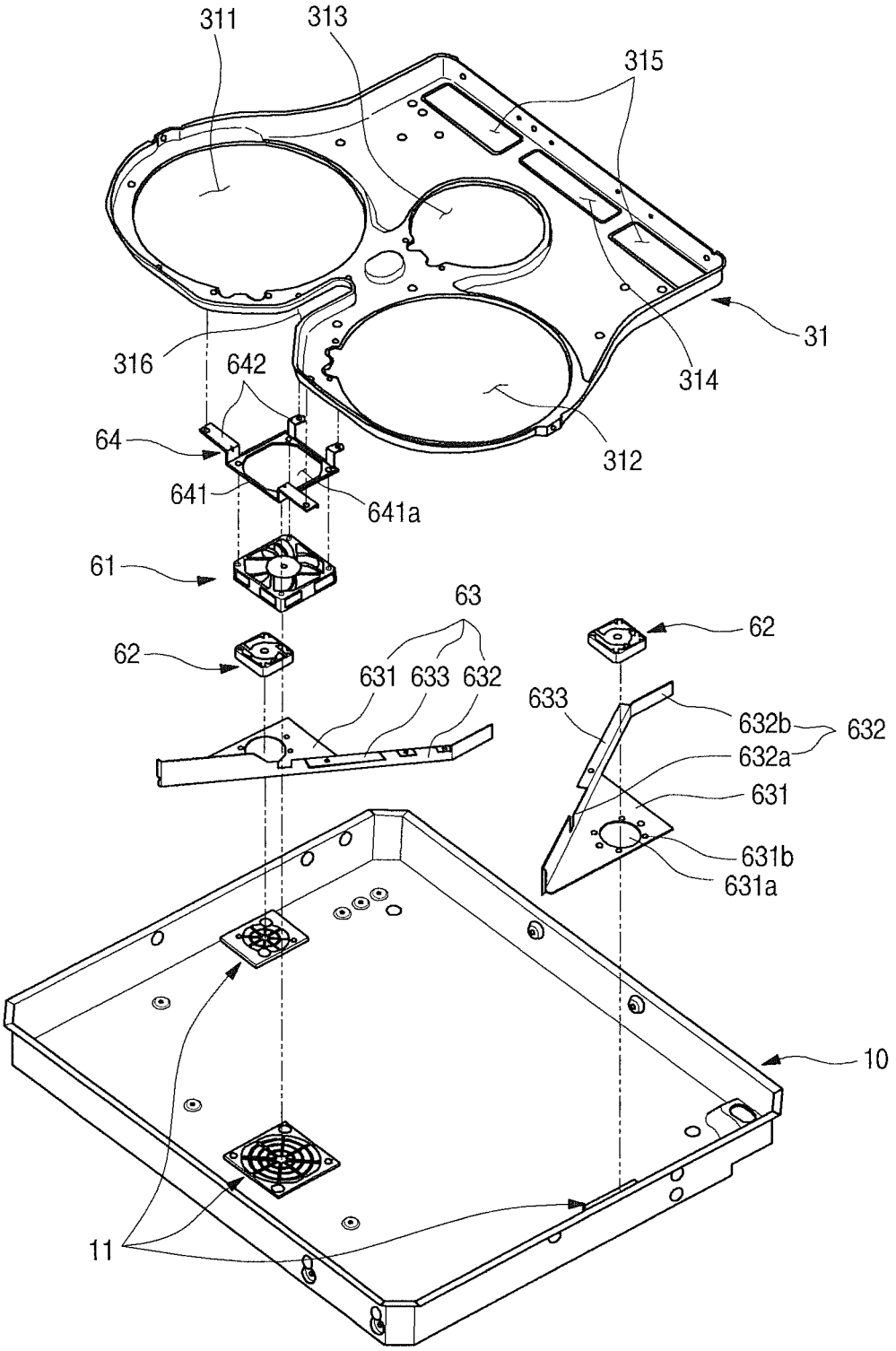
FIG. 6 is a diagram illustrating an inside area of an example gas cooker.

FIGS. 5-6 illustrate an inside area of an example gas cooker.

As illustrated in the drawings, the main fan 61 and the sub-fan 62 for flowing air in the case 10 may be provided inside the case 10. Each of the main fan 61 and the sub-fan 62 is formed to have a box fan, and also formed to suction air outside the case 10 and then to discharge the suctioned air from an inside of the case 10. In some implementations, a structure of the fan may be employed according to a user's selection.

The main fan 61 and the sub-fan 62 enable external air to be introduced to the inside of the case 10 having a sealed structure, and simultaneously enable the air inside the case 10 to forcibly flow and thus to cool the inside of the case 10. And the air forcibly flowing in the case 10 may be discharged to an outside through the exhaust outlet 21.

And the main fan 61 may be provided between the first burner 401 and the second burner 402, and may be provided among the first burner 401, the second burner 402 and the operation unit 23. That is, the main fan 61 is located at a location formed among the operation unit 23, the first burner 401 and the second burner 402.

The air forcibly flows toward the operation unit 23 by driving of the main fan 61, and thus may cool a circuit unit 231 forming the operation unit 23. For example, the circuit unit 231 can be implemented as a printed circuit board ("PCB"). In detail, the PCB 231 may be mounted in inside an operation unit case 232 forming an outer appearance of the operation unit 23, and a case inlet port 234 may be formed to be opened in the operation unit case 232. The case inlet port 234 may be opened to a position adjacent to the main fan 61, and it may be configured so that the air blown by the main fan 61 is introduced to the inner side of the operation unit case 232 through the case inlet port 234 and may cool the PCB 231.

Through cooling of the PCB 231, the operation unit 23 and the operation part 201 of the top plate 20 may be cooled so that the user does not feel discomfort due to heat generated when operating the operation part 201 of the top plate 20.

And by the driving of the main fan 61, the air outside the case 10 is introduced, and forcibly flows radially centering on the case 10, and some of the air may flow along perimeters of the first burner 401 and the second burner 402, and thus heat from the first burner 401 and the second burner 402 does not stay at the inside of the case 10, but is discharged to the outside.

Therefore, the internal space of the case 10 may be cooled by the driving of the main fan 61, and may also protect electronic components in the case 10, i.e., the PCB 231 forming the operation unit 23.

The main fan 61 is fixed to and installed at a lower surface of the insulating case 31 by a main fan bracket 64, and may be disposed between a first burner hole 311 and a second burner hole 312. And the main fan bracket 64 enables the main fan 61 to be installed to be spaced apart from the insulating case 31, and may also be formed to extend at a height at which the main fan 61 is in completely close contact with a fan installing portion 11.

The sub-fan 62 serves to cool the regulator 51 and the valve unit 52 provided at both of the left and right sides in the case 10, and is provided at each of the left and right sides of the case 10. And the sub-fan 62 is provided inside a space partitioned by a barrier 63, and by the barrier 63, a space in which the regulator 51 and the valve unit 52 are disposed may be partitioned from the space in which the burner 40 is provided. Therefore, by driving of the sub-fan 62, the air outside the case 10 may be introduced into the space partitioned by the barrier 63, and the regulator 51 and the valve unit 52 may be cooled separately from the space in which the burner 40 is disposed.

In some implementations, the fan installing portion 11 is formed at a bottom surface of the case 10 on which the main fan 61 and the sub-fan 62 are installed. The fan installing portion 11 may be formed to protrude in a shape corresponding to the main fan 61 and the sub-fan 62, such that the main fan 61 and the sub-fan 62 are seated thereat.

Since the case 10 has a structure in which the remaining portions except the fan installing portion 11 are sealed, the air introduced into the case 10 may be enabled only through the fan installing portion 11.

Therefore, the main fan 61 and the sub-fan 62 may have a structure which is in completely close contact with the case 10, and the suctioned air may be prevented from leaking through a gap between the case 10 and the main fan 61 or the sub-fan 62.

The fan installing portion 11 may be formed to protrude by a foaming when the case 10 is molded, and a grille shape may be formed at an opening of a protruding upper surface of the fan installing portion 11, and thus a foreign substance is prevented from being introduced while the air is suctioned.

And a cooling air blocking member 53 for protecting the nozzle 33 and the mixing tube 34 is further provided at the case 10. The cooling air blocking member 53 is fixed to and installed at the bottom surface of the case 10 corresponding to a location at which the nozzle 33 is installed, and also bent to cover an outside of the nozzle 33.

Specifically, both of side ends of cooling air blocking member 53 are bent upward, and form a shielding portion 531, and the shielding portion 531 shields one side of each of the nozzle 33 and the mixing tube 34 including a space between the nozzle 33 and the mixing tube 34, and thus the air forcibly blown by rotation of the main fan 61 is prevented from being introduced into the space between the nozzle 33 and the mixing tube 34 and having an influence on supplying of the mixed gas.

And, the regulator 51 which constantly adjusts a pressure of the gas supplied from an outside and the valve unit 52 which selectively supplies the gas supplied from the regulator 51 to the burner port 41 may be provided inside the case 10.

The regulator 51 and the valve unit 52 may be disposed at both corners of a rear end inside the case 10 in consideration of an arrangement and a structure of the burner unit 30 provided inside the case 10. The regulator 51 and the valve unit 52 are located in opposite directions to each other, and formed to be connected to each other by the gas pipe 35 such that the gas is supplied thereto.

And the sub-fan 62 is provided in front of each of the regulator 51 and the valve unit 52. The sub-fan 62 which serves to suction the air outside the case 10 into the case 10, then to blow the air toward the regulator 51 and the valve unit 52, and thus to cool the regulator 51 and the valve unit 52 may be disposed at the left and right sides of the case 10.

The barrier 63 is provided at the left and right sides inside the case 10. The barrier 63 provides an installing surface of the sub-fan 62, also enables the air blown by the sub-fan 62 to effectively cool the regulator 51 and the valve unit 52, and enables the air to be discharged toward the exhaust outlet 21.

Both ends of the barrier 63 are coupled to both a side surface and a rear surface of the case 10. For example, the barrier 62 may be fixed to and installed at a side surface and a rear surface of the case 10, respectively, and provide a space in which the regulator 51 or the valve unit 52 and the sub-fan 62 are disposed. A space partitioned by the barrier 63 is an outer area of the burner unit 30 which may form a space in the case 10 to be separated from the burner unit 30.

Therefore, the air forcibly flowing by an operation of the sub-fan 62 may effectively cool the space in the area partitioned by the barrier 63. That is, the external air suctioned by the sub-fan 62 is not mixed with the high-temperature air in the space in which the burner unit 30 is disposed, and thus may more effectively cool the regulator 51 and the valve unit 52.

The barrier 63 may be fixed to and installed at the lower surface of the insulating case 31, and may connect between the insulating case 31 and the case 10 to partition a space.

Figure 7:
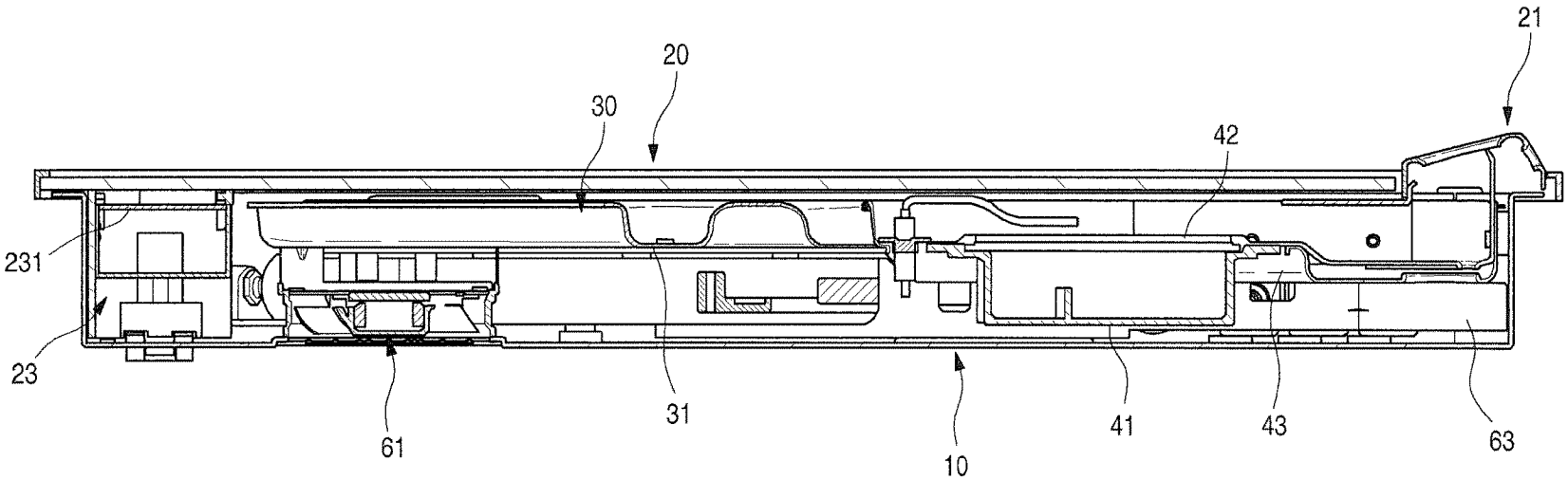
FIG. 7 is a diagram illustrating a cross-sectional view of the example gas cooker of FIG. 1.
Figure 8:
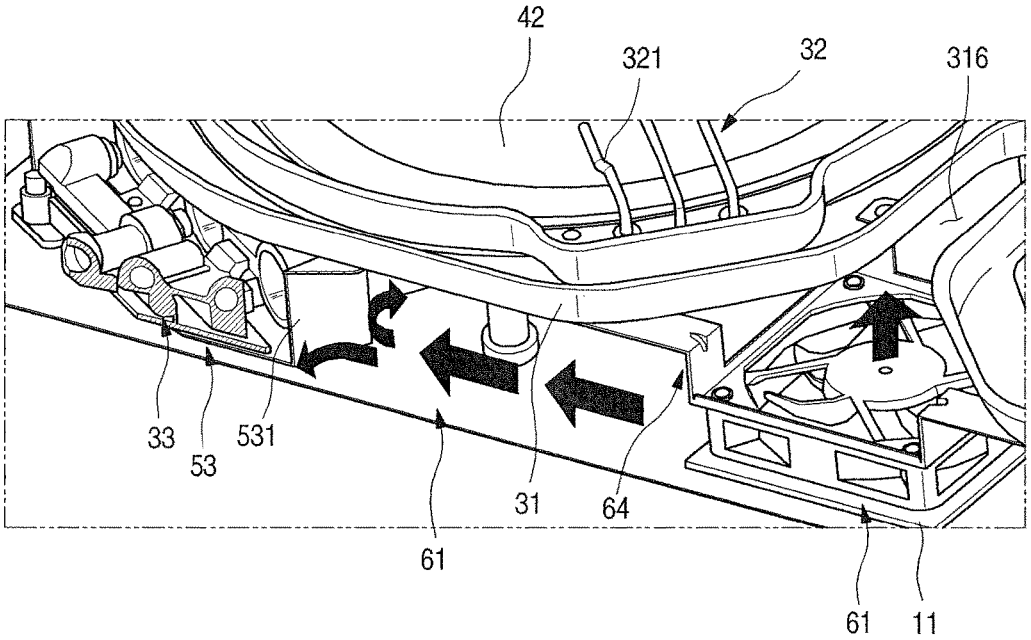
FIG. 8 is a diagram illustrating a cooling unit and a blocking member of an example gas cooker.
Figure 9:
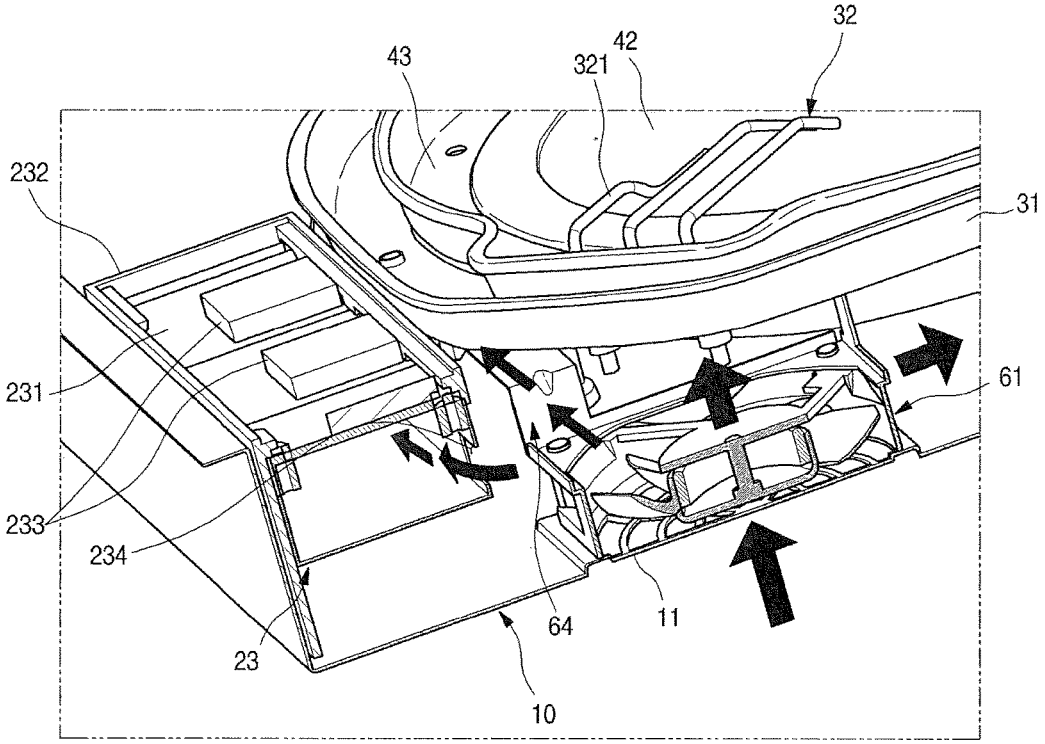
FIG. 9 is a diagram illustrating a cooling unit and an operation unit of an example gas cooker.

FIG. 7 illustrates a cross-sectional view of the example gas cooker of FIG. 1. FIG. 8 illustrates a cooling unit and a blocking member of an example gas cooker. FIG. 9 illustrates a cooling unit and an operation unit of an example gas cooker.

As shown in the FIGS. 7-9, the main fan 61 is disposed in a front portion of the case 10, and is provided at a position adjacent to the operation unit 23. Therefore, the external air is suctioned by the drive of the main fan 61 and may supply cooling air toward the operation unit 23.

The operation unit 23 may be configured with the operation unit case 232 forming an outer shape and mounted to be fixed to the case 10, and the PCB 231 mounted on the operation unit case 232. A sensor 233 detecting an operation such as a touch sensor may be mounted in the PCB 231 and may be disposed so as to be in contact with or adjacent to a lower surface of the top plate 20. The sensor 233 may be configured with a different sensor 233 or device which may detect the operation of the user, not a touch sensor 233. And the case inlet port 234 through which the air blown by the main fan 61 is introduced may be formed in the operation unit case 232.

The PCB 231 may be disposed to be spaced apart from a lower surface of an inner side of the operation unit case 232 for improving the cooling efficiency. Further, the PCB 231 may be configured in multiple stages like FIG. 7 as necessary, and the PCB 231 may be disposed to be spaced apart in vertical from the inner side of the operation unit case 232.

That is, the PCB 231 is in close contact with a rear surface of the top plate 20, and may be configured with a touch PCB in which a touch sensor is mounted and a main PCB disposed to be spaced apart from a lower portion of the touch PCB and controlling operations of the main fan 61, the valve unit 52, the spark plug 32, and other elements inside the case 10. Therefore, the air blown by the main fan 61 may effectively cool the PCB 231 disposed to be spaced apart in multiple stages.

The main fan 61 is positioned to the rear of the operation unit 23 and may be disposed in the position corresponding to a central portion of the operation unit 23. Therefore, the cooling air blown by the operation of the main fan 61 may be supplied evenly to the entire operation unit 23.

In addition, the cooling air supplied from the main fan 61 may be configured to cool both upper and lower surfaces of the PCB 231. And, when the main fan 61 is positioned more adjacent to the operation unit 23, it may improve the cooling efficiency of the operation unit 23.

In addition, the cooling air blocking member 53 is provided on both side portions of the main PCB 231. The cooling air blocking member 53 may be provided on the bottom surface of the case 10 corresponding to the position of the nozzle 33, and may be formed to cover between the nozzle 33 and the mixing tube 34.

In detail, the cooling air blocking member 53 bends both side ends thereof upward and forms the shielding portion 531, the shielding portion 531 shields one sides of the nozzle 33 and the mixing tube 34 including the space between the nozzle 33 and the mixing tube 34 and prevents the air forcibly blown when the main fan 61 rotates from being introduced to the space between the nozzle 33 and the mixing tube 34 and affecting the mixed gas supply.

To this end, a transverse width of the cooling air blocking member 53 is larger than at least a distance between the nozzle 33 and the mixing tube 34, and the cooling air blocking member 53 has a structure shielding at least a portion of each of the nozzle 33 and the mixing tube 34 as well as the space between the nozzle 33 and the mixing tube 34 from a side.

Therefore, the cooling air blown by the operation of the main fan 61 is blocked by the cooling air blocking member 53 and cannot be introduced into the space between the nozzle 33 and the mixing tube 34, and is branched from the cooling air blocking member 53 and flows along peripheries of the first burner 401 and the second burner 402.

Also, an opening portion 316 of the insulating case 31 to be described below is positioned above the main fan 61, and the cooling air blown by the main fan 61 may directly cool the lower surface of the top plate 20.

Figure 10:
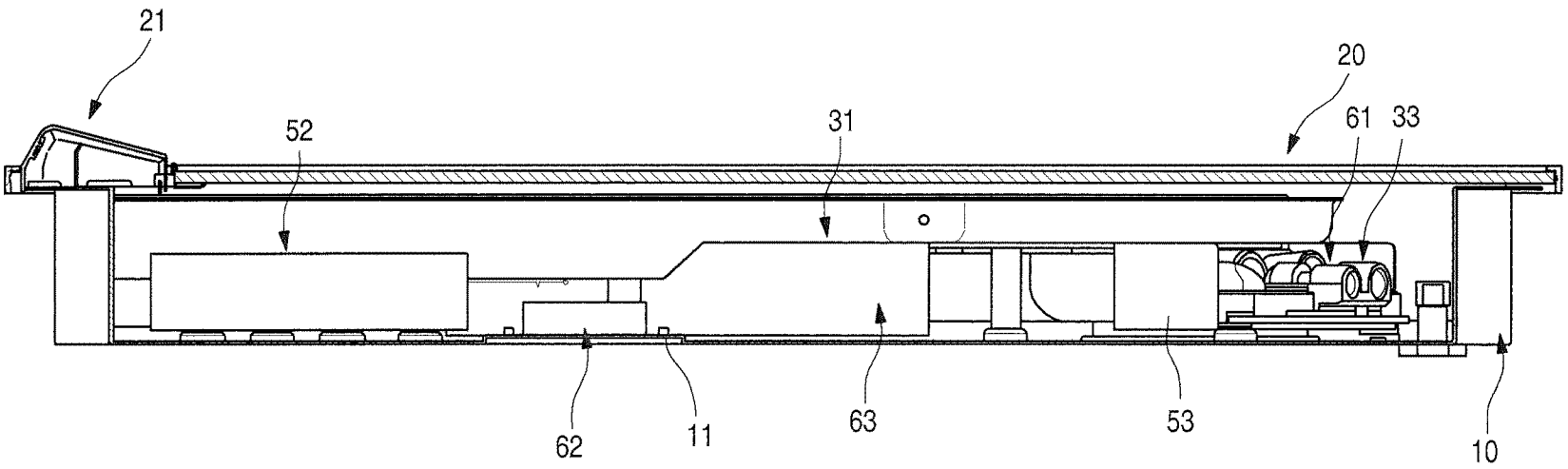
FIG. 10 is a diagram illustrating a cross-sectional view of an example gas cooker of FIG. 1.
Figure 11:
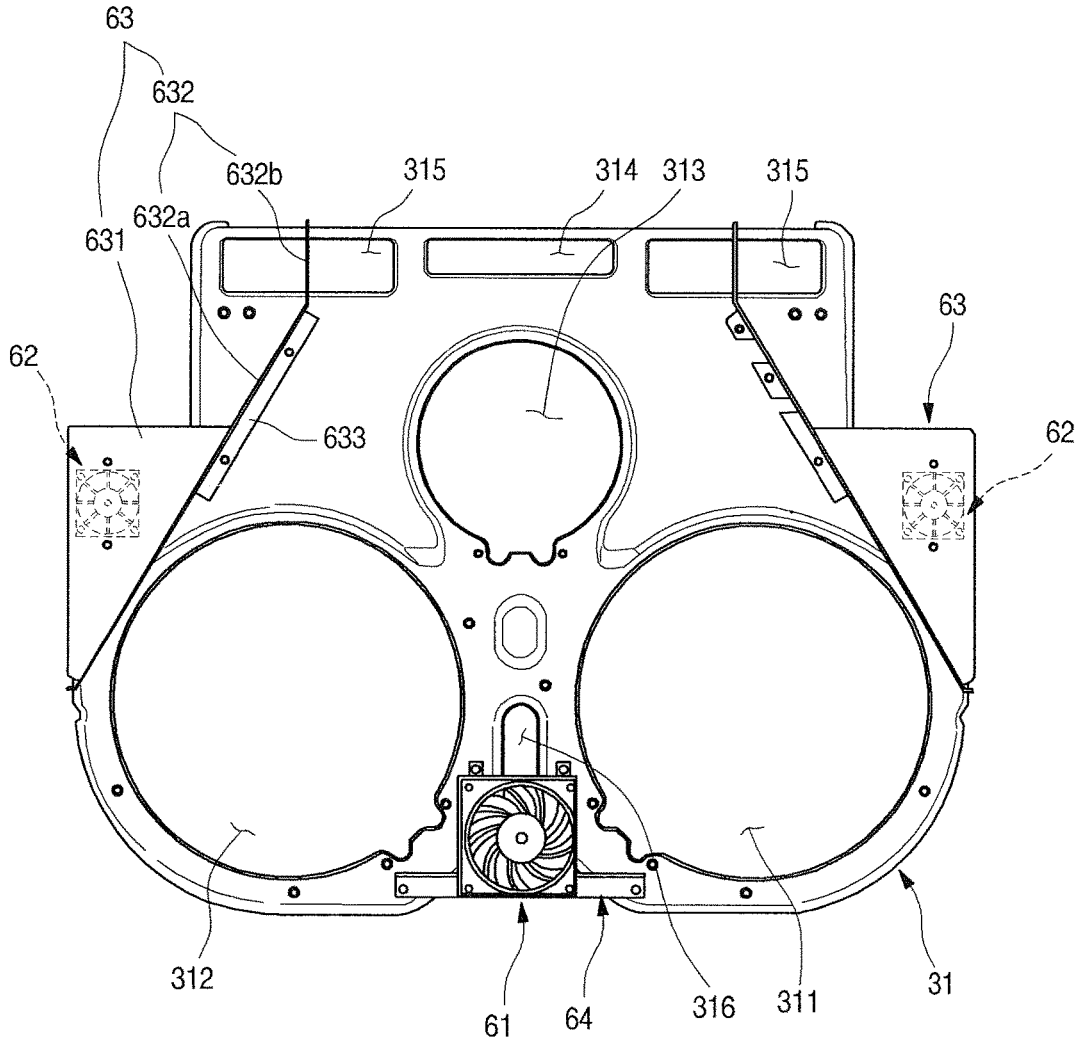
FIG. 11 is a diagram illustrating an example insulating case.
Figure 12:
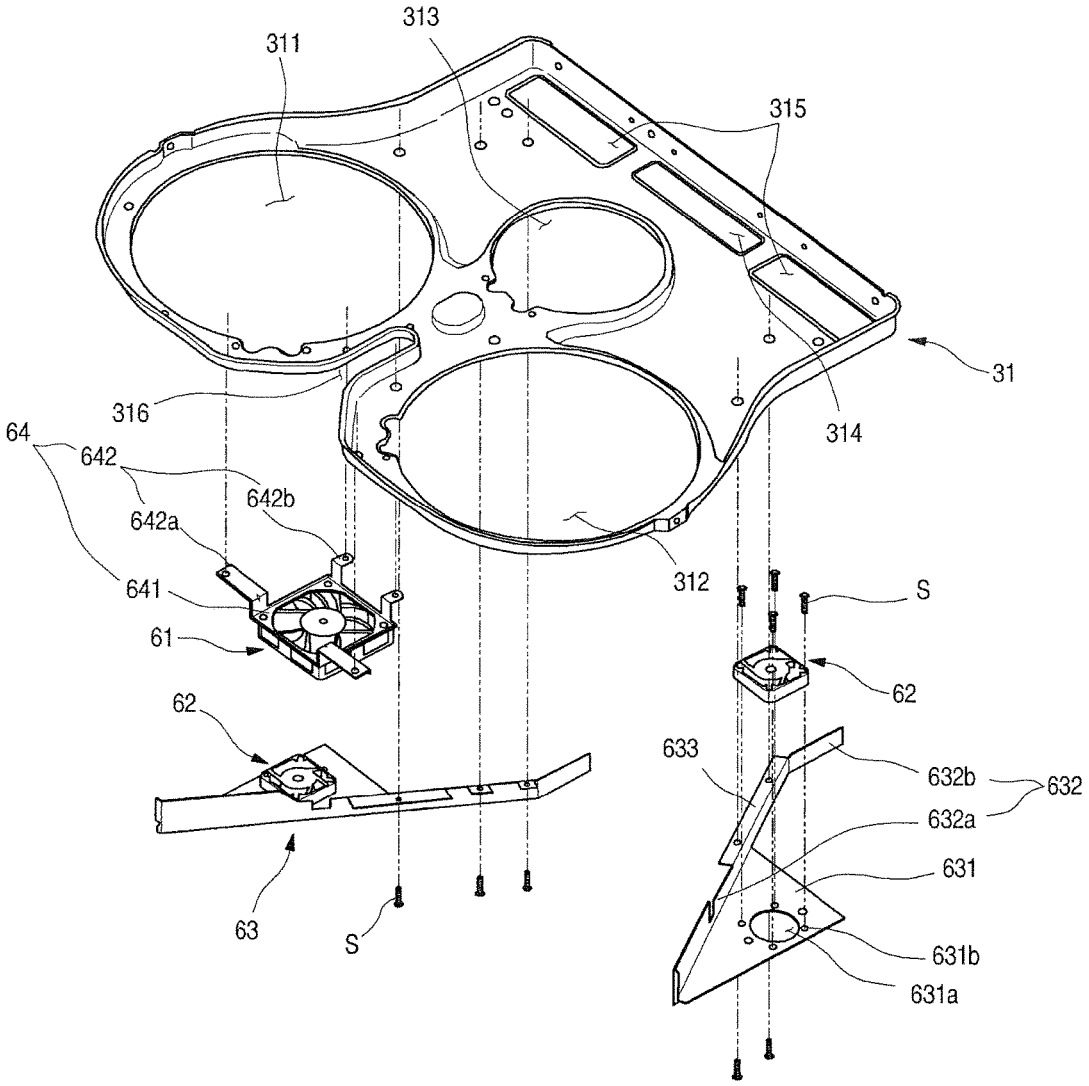
FIG. 12 is a diagram illustrating an insulating case, a cooling unit, and a barrier of an example gas cooker.

FIG. 10 illustrates a cross-sectional view of an example gas cooker of FIG. 1. FIG. 11 illustrates an example insulating case. FIG. 12 illustrates an insulating case, a cooling unit, and a barrier of an example gas cooker.

As illustrated in FIGS. 10-12, the first burner hole 311, the second burner hole 312 and a third burner hole 313 at which the first burner 401, the second burner 402 and the third burner 403 are respectively located are formed at the insulating case 31 so as to be opened.

And an exhaust opening through which exhaust gas generated by the combustion and internal air of the case 10 are discharged is formed at a rear end of the insulating case 31. The exhaust opening may include a central exhaust opening 314 formed at a center, and side exhaust openings 315 formed at both sides of the central exhaust opening 314.

The central exhaust opening 314 may be formed to be slightly narrower than an area of each of the side exhaust openings 315. This is to reduce an amount of high-temperature exhaust gas discharged through the central exhaust opening 314 and thus to reduce a temperature of the entire exhaust gas because a distance between the central exhaust opening 314 and the third burner 403 is relatively shorter than a distance between the first and second burners 401 and 402 and the side exhaust openings 315.

That is, an amount of exhaust gas discharged through the side exhaust openings 315 having a relatively low temperature may be enabled to be greater than that of exhaust gas discharged through the central exhaust opening 314, and thus the temperature of the entire exhaust gas which is mixed and discharged may be reduced.

Also, the opening portion 316 may be formed in a front end central portion of the insulating case 31. The opening portion 316 is positioned vertically above the mounting position of the main fan 61, and therefore the cooling air blown by the main fan 61 is formed to pass through the opening portion 316 during the operation of the main fan 61. Thus, the cooling air passing through the opening portion 316 may directly cool the lower surface of the top plate 20.

The opening portion 316 may be formed so that is a width thereof is gradually narrowed from the front which is an entrance to the rear. Therefore, the intensive blowing of the cooling air toward the entrance side of the opening portion 316 is possible, and the operation part 201 through which the user is operating and the front portion of the top plate 20 may be intensively cooled.

And, the main fan 61, the sub-fan 62 and the barrier 63 may be provided at the lower surface of the insulating case 31.

The main fan 61 is fixed to and installed at the lower surface of the insulating case 31 by the main fan bracket 64, and may be disposed between the first burner hole 311 and the second burner hole 312. And the main fan bracket 64 enables the main fan 61 to be installed to be spaced apart from the insulating case 31, and may also be formed to extend at a height at which the main fan 61 is in substantially contact with the fan installing portion 11.

And, the main fan bracket 64 may be mounted to the lower surface of the insulating case 31 so as to cross the opening portion 316. Also, the main fan 61 is mounted to the main fan bracket 64 and may be located vertically under the opening portion 316.

The main fan bracket 64 may be configured with a fan fixing portion 641 pressing and fixing the main fan 61 from above the main fan 61 and a fan coupling portion 642 extended upward from the fan fixing portion 641 and coupled to the lower surface of the insulating case 31.

The fan fixing portion 641 is formed of a plate which may be in contact along an edge of the main fan 61, and an opening 641*a* is formed in a center so that the air blown by the main fan 61 may pass through the opening 641*a*. And, the main fan 61 and the fan fixing portion 641 may be fastened to each other by a coupling member such as a screw or bolt at the fan fixing portion 641.

Also, the fan coupling portion 642 may be configured with a pair of first coupling portions 642*a* extended from a front end of both side surfaces of the fan fixing portion 641 to the right and left sides and a pair of a second coupling portions 642*b* extended from a rear end of the both side surfaces of the fan fixing portion 641 to the rear.

The first coupling portion 642*a* is extended to a side after extended upward in a predetermined length so as to be mounted to cross the entrance of the opening portion 316 which has a relatively large width. And the second coupling portion 642*b* may be fixed to an outside of the opening portion 316 after extended in the same height with the first coupling portion 642*a* and then extended to the rear.

And, a height of the fan coupling portion 642 may be formed in a height through which the main fan 61 may press the fan installing portion 11 upon mounting of the main fan 61. Therefore, when the insulating case 31 is seated in the case 10 while the main fan 61 is mounted on the main fan coupling portion 642, a lower end of the main fan 61 presses and is in close contact with the fan installing portion 11, thereby preventing outdoor air leakage.

And the barrier 63 is fixed to and installed at both of left and right sides of the insulating case 31. The barrier 63 may be fixed by a welding, or may be fixed to and installed at the insulating case 31 by a separate fastening member S such as a rivet, a bolt and a screw.

The barrier 63 may generally include a fan seating portion 631 providing a surface on which the sub-fan 62 is seated, and a partitioning portion 632 which partitions the internal space of the case 10.

In particular, the fan seating portion 631 is formed in an approximately triangular plate shape, and also formed to be in contact with the upper surface of the fan installing portion 11. And an opening 631*a* through which the air is introduced and a coupling hole 631*b* to which the fastening member S is fastened are formed at the fan seating portion 631. The fastening member S passes through the sub-fan 62 and the coupling hole 631*b*, and is fastened therein. Therefore, the sub-fan 62 may be fixed to the fan seating portion 631 by fastening the fastening member S, and the barrier 63 installed at the insulating case 31 may be assembled inside the case 10 together with the insulating case 31. At this point, the sub-fan 62 and the fan seating portion 631 on which the sub-fan 62 is seated may be installed to be in completely close contact with the protruding fan installing portion 11.

And the fan seating portion 631 is formed in a right-angled triangular shape, and also formed so that one inclined end thereof is connected to the partitioning portion 632, and the other end is in close contact with a side surface of the case 10. Therefore, the barrier 63 may be maintained in a stably fixed state without vibration due to an air flow.

The partitioning portion 632 is formed to be vertically bent upward from the inclined end of the fan seating portion 631, and also formed to be fixed to a lower end of the insulating case 31 and to partition the internal space of the case 10.

And the partitioning portion 632 extends along the inclined end of the fan seating portion 631, may further extend outward, and thus may include a first partitioning portion 632*a* which partitions the case 10, and a second partitioning portion 632*b* which is bent from an end of the first partitioning portion 632*a* and partitions the side exhaust opening 315.

The first partitioning portion 632*a* is formed to partition a space between the insulating case 31 and the case 10, and to guide the flow of the air blown by the sub-fan 62.

And the second partitioning portion 632*b* is bent from the end of the first partitioning portion 632*a*, passes through the side exhaust opening 315, and extends to be in contact with the rear end of the case 10. Accordingly, by the second partitioning portion 632*b*, the side exhaust opening 315 may be divided into both of left and right sides based on the second partitioning portion 632*b*, and the cooling air flowing along the first partitioning portion 632*a* may be independently discharged through the side exhaust opening 315 partitioned by the second partitioning portion 632*b*.

In some implementations, a bent portion 633 which is bent outward may be further formed at an upper end of the first partitioning portion 632*a*. The bent portion 633 is in contact with the lower surface of the insulating case 31. And the fastening member S such as a screw and a bolt may be fastened to the bent portion 633 and the insulating case 31, and thus the barrier 63 may be fixed and installed.

Figure 13:
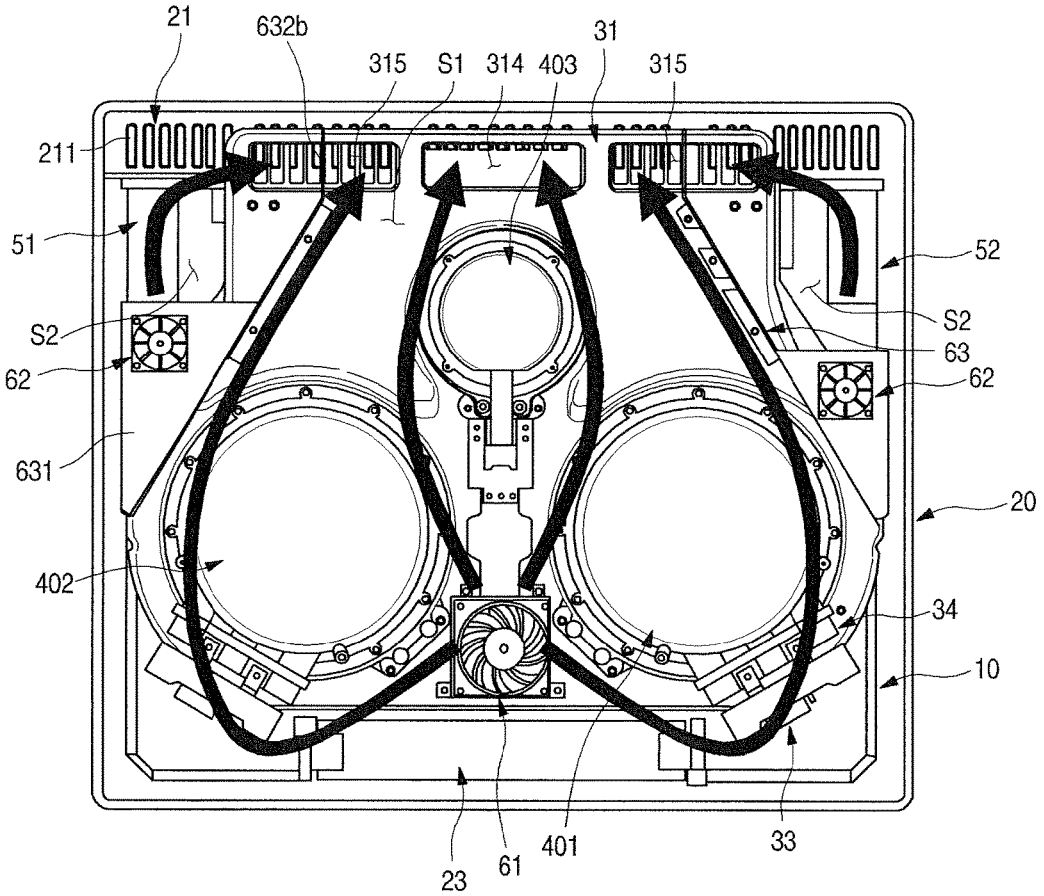
FIG. 13 is a diagram illustrating an example air flow inside an example gas cooker.
Figure 14:
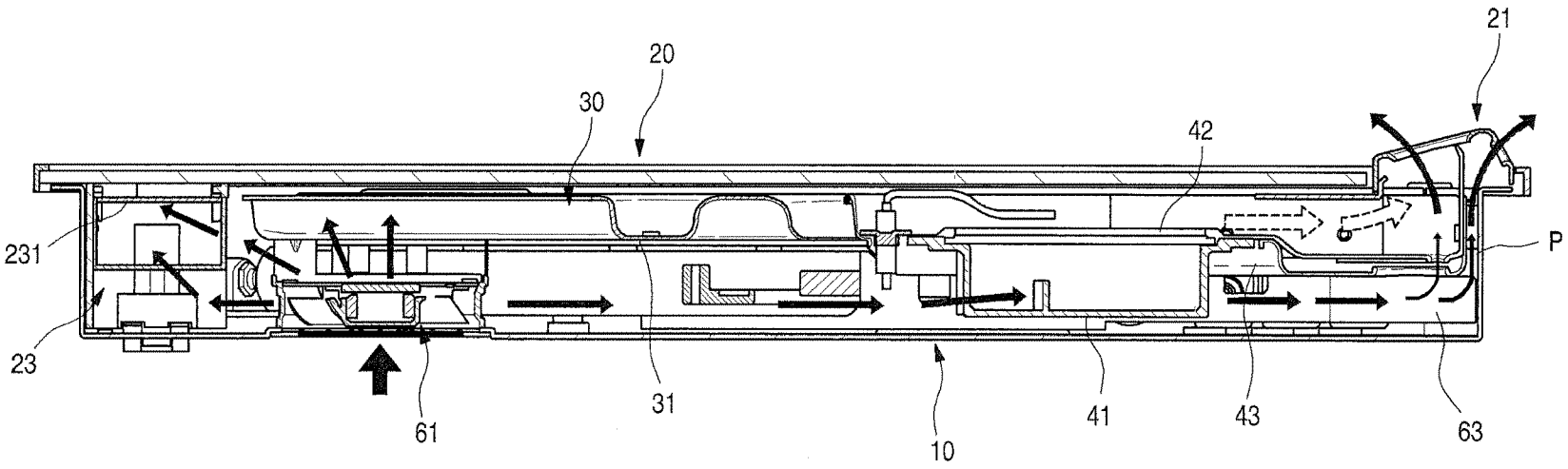
FIG. 14 is a diagram illustrating an example air flow inside the example gas cooker of FIG. 1.
Figure 15:
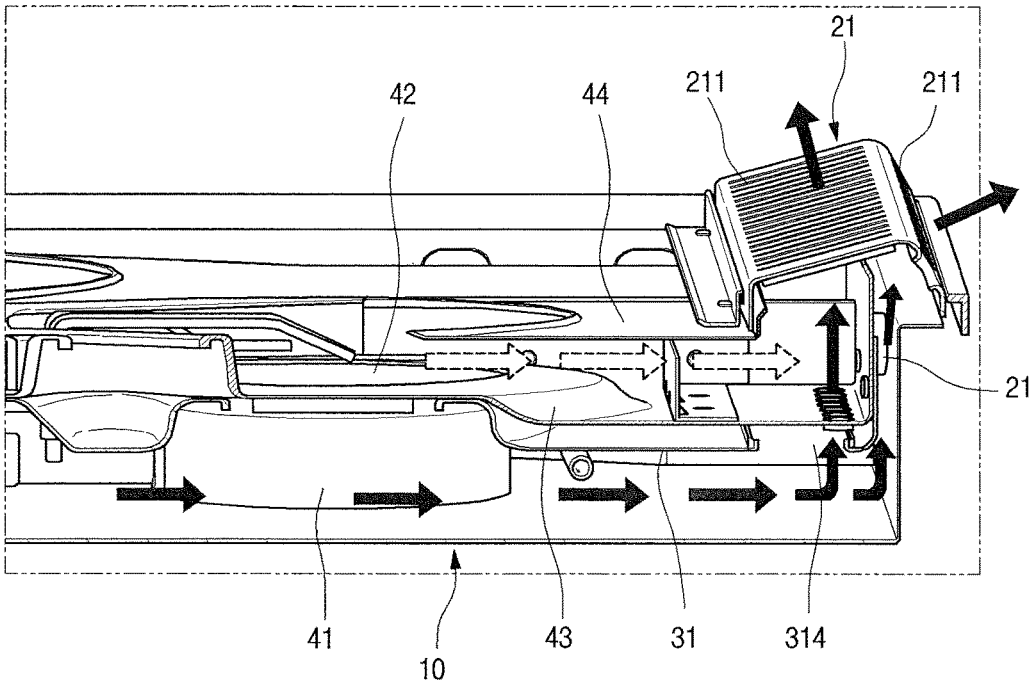
FIG. 15 is a diagram illustrating an example air flow inside an example gas cooker.

FIG. 13 illustrates an example air flow inside an example gas cooker. FIG. 14 illustrates an example air flow inside the example gas cooker of FIG. 1. FIG. 15 illustrates an example air flow inside an example gas cooker.

As illustrated in the drawing, the user operates the operation part 201 exposed to the top plate 20 to use the gas cooker 1. By operating the operation part 201, an operating signal may be input through the operation unit 23. Opening and closing of the valve unit 52 is determined by the operating signal, and thus the gas may be supplied to the desired burner 40.

When the gas is mixed with the air, and then supplied to the desired burner 40 in a mixed gas state, the mixed gas is ignited by the spark plug 32, and the combustion occurs at the red-heat plate 42, and thus the red-heat plate 42 may be heated. Due to heating of the red-heat plate 42, the red-heat plate 42 may radiate radiant waves to an outside, and may heat food or a container in which the food is put.

The user may control heating power of the burner 40 through the operation of the operation part 201, and may also visually check an ignition state and a heating state through the top plate 20 because visible rays are included in the radiant wave generated upon the ignition and the heating of the burner 40.

In some implementations, the main fan 61 and the sub-fan 62 are driven along with the ignition of the burner 40. By the driving of the main fan 61, the air in the case 10 may be suctioned toward the main fan 61. The suctioned air is discharged radially centering on the main fan 61.

Some portion of the air blown through the main fan 61 flows toward the PCB 231 of the operation unit 23, and thus the PCB 231 is continuously cooled to be normally operated.

Also, another portion of the air blown through the main fan 61 is flowing upward, and may be in direct contact with the lower surface of the top plate 20 through the opening portion 316. Therefore, intensive cooling of the forward portion of the top plate 20, particularly a position adjacent to the operation part 201 through which the user is operating may be possible.

And a portion of the air blown through the main fan 61 may pass between the first burner 401 and the second burner 402, and then may be discharged to the central exhaust opening 314 along an outer side surface of the third burner 403.

And the remaining portion of the air blown through the main fan 61 flows along a space among the first burner 401, the second burner 402 and the side surface of the case 10, flows along the barrier 63 which partitions the internal space of the case 10, and then may be discharged to one side of the side exhaust opening 315.

As described above, by rotation of the main fan 61, the air in the case 10 does not stay, but continuously cools the operation unit 23 and the front half portion of the top plate 20 at which a cooling unit is located, and the air close to the first burner 401, the second burner 402 and the third burner 403 is discharged, and thus an internal temperature of the case 10 is prevented from being increased to a preset temperature or more.

And by the flow of the cooling air discharged through the central exhaust opening 314 and the side exhaust opening 315, the burned gas generated upon the combustion in the first burner 401, the second burner 402 and the third burner 403 may be mixed with the cooling air by a pressure difference, and may be discharged together. At this point, the high-temperature burned gas is mixed with the cooling air discharged from the inside of the case 10, and is in a low-temperature state, and then may be discharged to the outside through the vent holes 211 of the exhaust outlet 21.

In some implementations, a protruding portion 12 which protrudes forward is formed at the rear surface of the case 10, and the rear end of the insulating case 31 and the protruding portion 12 are in contact with each other. Therefore, the rear end of the insulating case 31 and the rear surface of the case 10 may be spaced apart from each other, and may form passages separated from each other.

Therefore, the cooling air blown by the main fan 61 flows backward along the space between the insulating case 31 and the case 10. And at the rear end of the case 10, a portion of the cooling air may pass through the central exhaust opening 314 and the side exhaust openings 315, may be mixed with the burned gas in the burner 40, and then may be discharged through the exhaust outlet 21. And another portion of the cooling air may pass through the central exhaust opening 314 and the side exhaust openings 315, may flow to the rear end of the case 10, may flow through a passage formed by the rear end of the insulating case 31 and the rear surface of the case 10, and then may be discharged through the exhaust outlet 21.

Therefore, an outer side surface of the case 10 may be cooled by the cooling air, may protect the sink at which the gas cooker 1 is installed or other elements which form an exterior, and may prevent a damage thereof due to heat.

In some implementations, when the sub-fan 62 is driven, the external air outside the case 10 is introduced into the case 10, and second spaces S2 formed at both sides of the case 10 and partitioned by the barrier 63 may be independently cooled.

Hereinafter, the air flow inside the case 10 by the sub-fan 62 will be described in detail with reference to the drawings.

Figure 16:
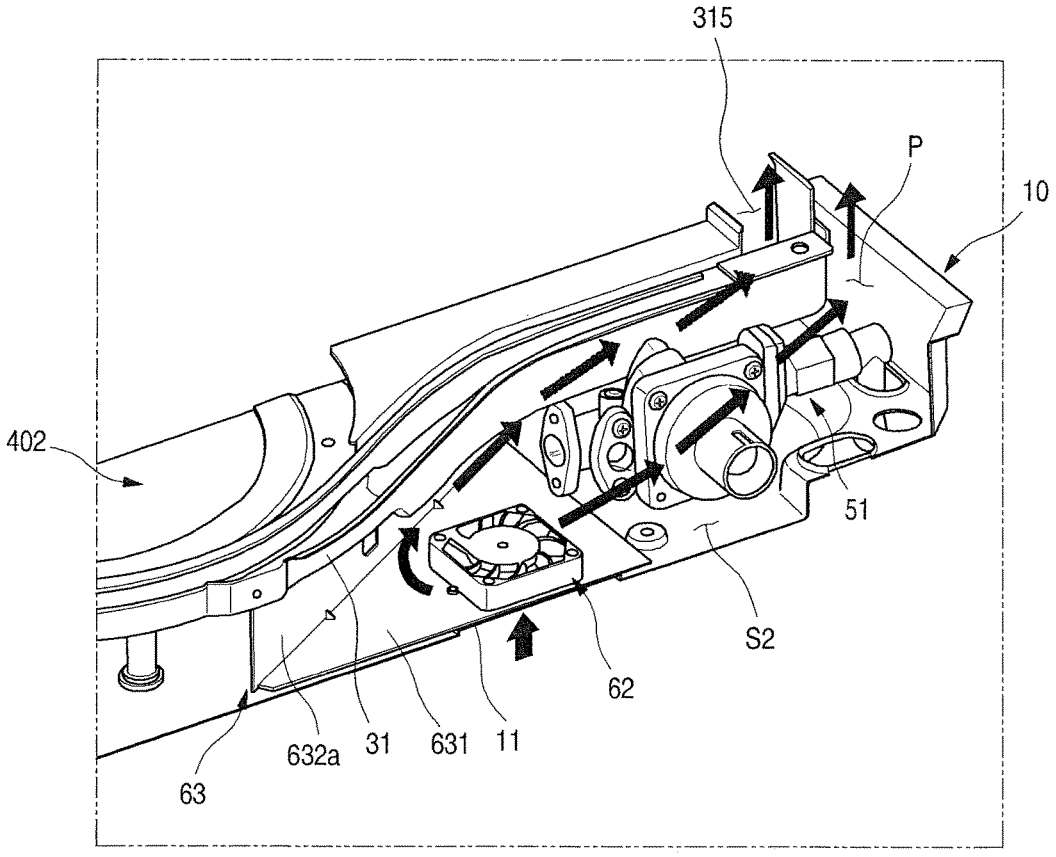
FIG. 16 is a diagram illustrating an example air flow inside an example gas cooker.
Figure 17:
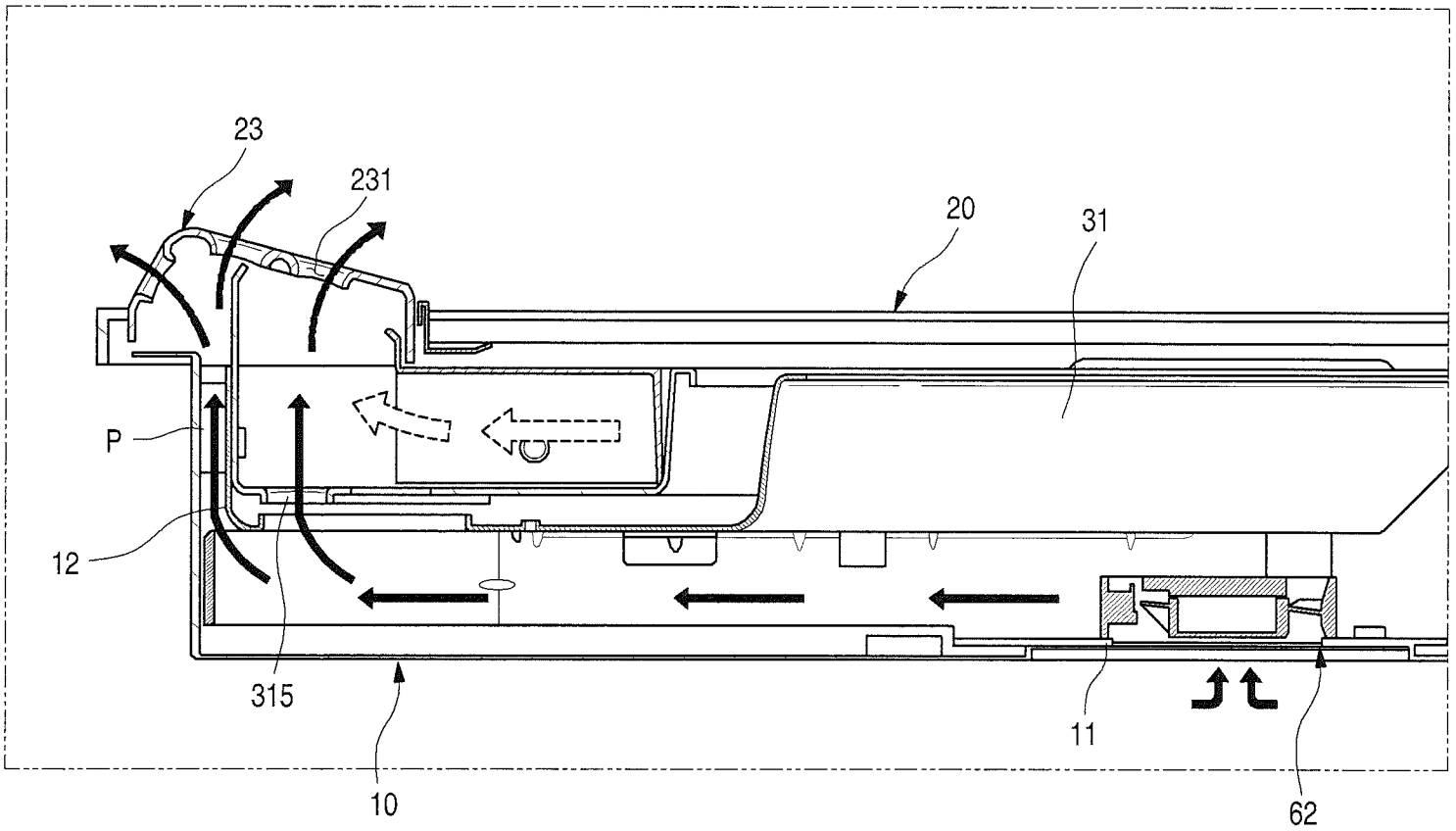
FIG. 17 is a diagram illustrating an example air flow provided from a cooling unit of an example gas cooker.

FIG. 16 illustrates an example air flow inside an example gas cooker. FIG. 17 illustrates an example air flow provided from a cooling unit of an example gas cooker.

As illustrated in the figure, the air outside the case 10 is sucked into the case 10 by the rotation of the sub-fan 62. The sucked air is discharged radially centering on the sub-fan 62 and forcibly flows from the second space S2 partitioned by the barrier 63.

Some of the air which forcibly flows by the sub-fan 62 cools the regulator 51 while passing through the regulator 51. The regulator 51 may be cooled by the air which is continuously blown by the sub-fan 62, and may be cooled by the air introduced from the outside in the space partitioned by the barrier 63.

Even when the burner 40 is operated at high temperature in the inside of the case 10, the pure external air not mixed with the air of a position partitioned from a first space S1 in which the burner 40 is positioned and adjacent to the burner 40 is supplied to the regulator 51 side after being introduced to the second space S2, and thus the regulator 51 may be cooled more effectively.

In some implementations, another portion of the air forcibly flows by the sub-fan 62 flows along the partitioning portion 632 of the barrier 63, and may be discharged through the side exhaust opening 315 by the second partitioning portion 632*b*.

At this time, the second partitioning portion 632*b* is formed to be extended to the rear end of the case 10 across the side exhaust opening 315, and the rear end of the insulating case 31 is formed to be spaced apart from the rear surface of the case 10 by a protruding portion 12 of the rear surface of the case 10.

Some of the air flown along the partitioning portion 632 may be discharged through the side exhaust opening 315 while being mixed with the burned gas of the burner 40, and therefore, the air may lower the temperature of the exhaust gas discharged to the exhaust outlet 21.

And, another portion of the air flown along the partitioning portion 632 may pass the side exhaust opening 315 and may be discharged to the exhaust outlet 21 through a flow path P between the insulating case 31 and the rear surface of the case 10. Therefore, since the outer side surface of the case 10 may be cooled, other configurations forming an exterior or sink in which the gas cooker 1 is mounted can be protected and prevented from being damaged by the heat.

In some implementations, a structure cooled by the sub-fan 62 is described based on the regulator 51, but since the cooling structure and operation of the valve unit 52 located at the opposite position is the same except a direction thereof.

In some implementations, the gas cooker may be independently installed at a separate case.

Figure 18:
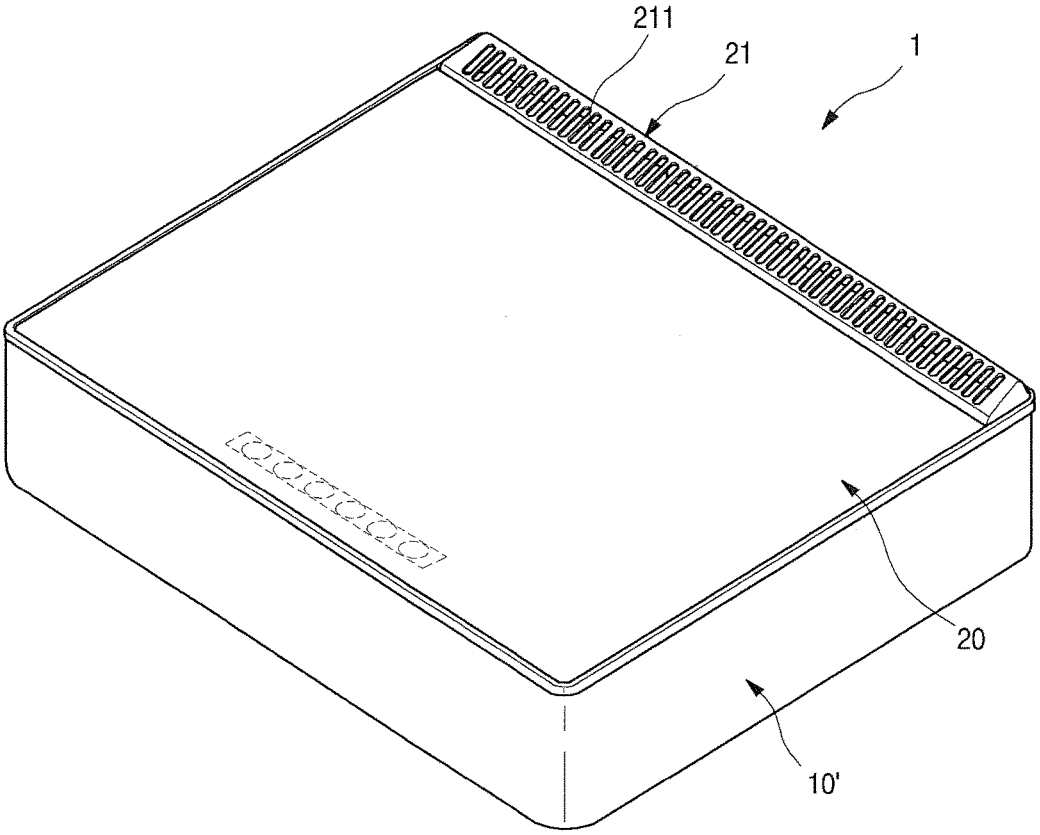
FIG. 18 is a diagram illustrating an example gas cooker.

FIG. 18 is a perspective view of a gas cooker.

As illustrated in the drawing, a gas cooker 1 includes the same top plate 20 and case 10 as those in the previous implementations, and an internal structure of the case 10 may also be the same.

However, the gas cooker 1 may be formed to be seated on an outer case 10' which forms an exterior while the top plate 20 and the case 10 are assembled.

In some implementations, instead of the configuration of the case 10, the top plate 20 may be directly installed at the outer case 10', and all of the elements including the burner unit 30 which are disposed in the case 10 may be installed inside the outer case 10'.

The internal space of the case may be cooled in three dimensions by the main fan and the sub-fan, and in particular, the electronic components such as the operation unit, the regulator and the valve unit may be cooled. Therefore, there is an advantage that the electronic components may be effectively cooled and the operational stability of the regulator and the valve unit may be ensured through this.

In particular, since a space in which the regulator and the valve unit are disposed is partitioned with a space of the burner unit by the barrier, the outdoor air may directly cool the regulator and the valve unit without being affected by the heat of the burner unit. Therefore, there is an advantage that the cooling efficiency of the regulator and the valve unit may be improved, and also the operational stability of the regulator and the valve unit may be ensured.

The overall cooling of the case is possible by the main fan and the sub-fan, in particular, a space between the lower surface of the insulator cover and the case may be sufficiently cooled, the thickness of the case may be reduced, and even if the thickness of the case is small, the thermal stability may be secured by lowering the temperature transferred to the outside. Therefore, the damage of furniture is prevented and the use stability of the user may be secured in the built-in structure through which the gas cooker is mounted on the furniture.

The cooling air supplied by the main fan and the sub-fan may be discharged through the exhaust outlet, at this time, it is mixed with the high temperature burned gas exhausted from the burner unit through the exhaust outlet, as a whole temperature of the exhaust gas is lowered, and thus there is an advantage that the thermal stability may be obtained and the emotional complaints of the user may be eliminated.

In addition, since a portion of the cooling air guided by the barrier may be discharged to the outside through the flow path formed between the end of the insulating case and the case, the temperature of the end of the case which is adjacent to the exhaust outlet through which the exhaust gas is discharged may get lower, and the heat transferred to the outside of the gas cooker is reduced so there is an advantage that the thermal stability may be further improved.

The main fan is positioned on the front portion, and in particular, since it may cool the operation unit at a position adjacent to the operation unit, there is an advantage that the operation unit is not malfunctioned in the high temperature environment and a normal operation may be maintained.

In particular, by the implementation of a cooling structure by the main fan, an electronic component which is sensitive to heat may be applied to the operation unit in the gas cooker which is employing the high temperature burner structure by heating of gas, and therefore, it is possible to implement an operation method not exposing components to the outside, instead of adopting a mechanical operational knob, thereby enriching the appearance.

Since a cooling air blown by the main fan may directly cool the top plate through the opening portion of the insulating case, the cooling of the front surface portion of the top plate in which the operation part is positioned is possible, and therefore, the emotional complaints which may be generated upon the user's touch operation may be relieved.

The cooling air blocking member which may prevent the cooling air which is forcibly flowed by the main fan from being introduced between the nozzle and the mixing tube is provided. Therefore, even during the cooling action of the inside of the case by the main fan, the gas supply through the nozzle may be made effectively, and there is an advantage that the burner may be prevented from being extinguished or the mixing ratio of the mixed gas may be prevented from being abnormally changed.

The regulator and the valve unit are provided on the rear end edges of the case and disposed to be separated from the burner unit by the barrier so that the internal space of the case can be used efficiently, and there is an advantage that the entire thickness of the gas cooker may be slimmed through this.

In addition, since the regulator and the valve unit are disposed at a position less affected by heat and at the same time, the cooling fan may cool the inside of the case, there is an advantage that the use stability may be secured by lowering the temperature transferred to the outside while the gas cooker becomes slim.

Although implementations have been described with reference to a number of illustrative examples, it should be understood that numerous other modifications and implementations can be implemented by those skilled in the art that will fall within the scope of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A gas cooker comprising:

a case defining an interior area, the case including an opening to the interior area;

a plate covering, fully or in part, the opening of the case;

a burner unit that is located in the interior area of the case, wherein the burner unit includes a heating element that is heated using gas;

an operation unit that is located at a first portion of the case and that is configured to control the burner unit based on user input;

a barrier that is located in the interior area of the case and that divides the interior area into a first area and a second area;

an exhaust outlet that is located at a second portion of the case; and a first cooling unit that is located in the interior area of the case and that is configured to generate air flow toward the exhaust outlet, wherein the burner unit includes:

a plurality of burners, and an insulating case that includes a plurality of openings that hold the plurality of burners, and wherein the barrier is coupled to a first surface of the insulating case, a first surface of the case, and a second surface of the case.

2. The gas cooker according to claim 1, wherein the operation unit includes:

a circuit unit that is coupled with the plate and that includes a touch sensor configured to sense the user input, and wherein the first cooling unit is configured to generate air flow between the circuit unit and a first surface of the case.

3. The gas cooker of claim 2, further comprising:

a spark plug configured to ignite fire to provide heat to the heating element; and a valve configured to control an amount of gas that is provided to the burner unit, wherein the circuit unit includes:

a first circuit unit that includes the touch sensor, and a second circuit unit that is configured to control the first cooling unit, the spark plug, and the valve, and wherein the first cooling unit is configured to provide air flow between the first circuit unit and the second circuit unit.

4. The gas cooker of claim 1, wherein the burner unit includes:

a burner port configured to hold the heating element, a mixing tube coupled to the burner port, a nozzle configured to provide gas to the mixing tube, and a blocking member configured to block air flow that is provided from the first cooling unit.

5. The gas cooker of claim 1, wherein the plurality of burners include:

a first burner located at a first position inside the case, and a second burner located at a second position inside the case, wherein the first cooling unit is located at a third position, inside the case, that is a position among the operation unit, the first burner, and the second burner.

6. The gas cooker of claim 1, wherein the insulating case includes:

a concaved portion that is coupled with the first cooling unit, wherein the first cooling unit is configured to generate air flow to the plate through the concaved portion of the insulating case.

7. The gas cooker of claim 6, wherein the case includes:
a first cooling unit installing portion that is coupled to the first cooling unit and that includes one or more openings that allow air to flow into the interior area from an exterior of the case.

8. The gas cooker of claim 7, further includes:
a bracket that is coupled between the first cooling unit and the concaved portion of the insulating case.

9. The gas cooker of claim 8, wherein the bracket includes:
a coupling portion that is coupled to the concaved portion of the insulating case, and
a fixing portion that is coupled to the first cooling unit and that enables coupling of the first cooling unit to the first cooling unit installing portion of the case.

10. The gas cooker of claim 8, wherein the insulating case is located in the interior area of the case and isolated from a first surface of the case and a second surface of the case, and
wherein the first cooling unit is configured to generate air flow between the insulating case and the case.

11. The gas cooker of claim 10, wherein the insulating case includes an exhaust opening that is located on a first surface of the insulating case and that allows air to flow from the first cooling unit to pass through the exhaust opening.

12. A gas cooker comprising:
a case defining an interior area, the case including an opening to the interior area;
a plate covering, fully or in part, the opening of the case;
a burner unit that is located in the interior area of the case, wherein the burner unit includes a heating element that is heated using gas;
an operation unit that is located at a first portion of the case and that is configured to control the burner unit based on user input;
an exhaust outlet that is located at a second portion of the case;
a first barrier that is located in the interior area of the case and that divides the interior area into a first area and a second area;
a first cooling unit that is located in the first area of the interior area and that is configured to generate air flow toward the exhaust outlet through the first area; and
a second cooling unit that is located in the second area of the interior area and that is configured to generate air flow toward the exhaust outlet through the second area,
wherein the burner unit includes:
a plurality of burners, and
an insulating case that includes a plurality of openings that hold the plurality of burners, and
wherein the first barrier is coupled to a first surface of the insulating case, a first surface of the case, and a second surface of the case.

13. The gas cooker of claim 12, further includes:
a second barrier that is located in the first area of the interior area and that divides the first area into a third area and a fourth area,
wherein the first cooling unit is located in the third area.

14. The gas cooker of claim 13, wherein the first barrier is coupled to a first surface of the case and a second surface of the case.

15. The gas cooker of claim 13, wherein the burner unit includes an exhaust opening that allows air to flow from the first cooling unit and the second cooling unit toward the exhaust outlet,
wherein the first barrier is coupled to a first surface of the burner unit.

16. The gas cooker of claim 15, wherein the burner unit is isolated from a first surface of the case, and
wherein air flow from the first cooling unit passes between the burner unit and the case.

17. The gas cooker of claim 13, further comprising:
a regulator configured to control gas pressure; and
a valve unit configured to control an amount of gas that is provided to the burner unit,
wherein the regulator and the valve unit are located in the second area of the interior area.

18. The gas cooker of claim 12, wherein the first barrier includes:
a seating portion that holds the second cooling unit; and
a partitioning portion that is bent from the seating portion and that divides the interior area into the first area and the second area.

19. A gas cooker comprising:
a case defining an interior area, the case including an opening to the interior area;
a plate covering, fully or in part, the opening of the case;
a burner unit that is located in the interior area of the case, wherein the burner unit includes a heating element that is heated using gas;
an operation unit that is located at a first portion of the case and that is configured to control the burner unit based on user input;
an exhaust outlet that is located at a second portion of the case; and
a first cooling unit that is located in the interior area of the case and that is configured to generate air flow toward the exhaust outlet,
wherein the burner unit includes:
a plurality of burners, and
an insulating case that includes a plurality of openings that hold the plurality of burners,
wherein the insulating case includes a concaved portion that is coupled with the first cooling unit, and
wherein the first cooling unit is configured to generate air flow to the plate through the concaved portion of the insulating case.

* * * * *